United States Patent [19]

Wessel

[11] 4,392,469

[45] Jul. 12, 1983

[54] RPM REGULATING DEVICE FOR THE FUEL INJECTION SYSTEM OF AN INTERNAL COMBUSTION ENGINE

[75] Inventor: Wolf Wessel, Oberriexingen, Fed. Rep. of Germany

[73] Assignee: Robert Bosch GmbH, Fed. Rep. of Germany

[21] Appl. No.: 294,079

[22] Filed: Aug. 19, 1981

[30] Foreign Application Priority Data

Oct. 10, 1980 [DE] Fed. Rep. of Germany ..... 3038293

[51] Int. Cl.[3] ..... F02M 39/00

[52] U.S. Cl. ..... 123/387; 123/449

[58] Field of Search ..... 123/387, 385, 386, 388, 123/449, 357, 503

[56] References Cited

U.S. PATENT DOCUMENTS

| | | | |
|---|---|---|---|
| 3,906,916 | 9/1975 | Laufer | 123/449 |
| 3,946,713 | 3/1976 | Laufer | 123/387 |
| 4,168,690 | 9/1979 | Hofer | 123/449 |
| 4,342,301 | 8/1982 | Tomita et al. | 123/506 |

FOREIGN PATENT DOCUMENTS

| | | | |
|---|---|---|---|
| 2813111 | 9/1979 | Fed. Rep. of Germany | 123/449 |

OTHER PUBLICATIONS

Straubel et al., Distributor Injection Pump, Aug. 1, 1979.

*Primary Examiner*—Charles J. Myhre
*Assistant Examiner*—Magdalen Moy
*Attorney, Agent, or Firm*—Edwin E. Greigg

[57] ABSTRACT

A regulator shaft, rotary centrifugal weights, and a governor member which is slidable on the regulator shaft, are arranged in a pressurized, fuel-filled inner chamber of a fuel injection apparatus. The centrifugal weights engage regulator springs via the governor member and a control sleeve. The governor member is closed adjacent the free end of the regulator shaft except for a throttle opening for communication with the inner chamber. The governor member is provided with a work chamber, one extremity of which is limited by the regulator shaft. A conduit leading to a fuel tank communicates with the work chamber. A magnetic valve connected to an electronic control device for control of the fuel flow is provided in the conduit. Opening the magnetic valve causes a pressure drop in the work chamber which in turn causes the governor member to press against the centrifugal weights, thus enhancing the fuel injection quantity so as to reduce deviations from those desired and pre-set.

7 Claims, 2 Drawing Figures

RPM REGULATING DEVICE FOR THE FUEL INJECTION SYSTEM OF AN INTERNAL COMBUSTION ENGINE

BACKGROUND OF THE INVENTION

The invention is directed to a centrifugal rpm regulating device for use in a fuel injection apparatus for an internal combustion engine having a governor for control of an injection pump in response to the volume of a work chamber. In an already known rpm regulating device of this general type the work chamber serves to dampen the rpm regulating device. This work chamber is arranged in the interior of the governor sleeve and communicates with the inner chamber of the injection pump which is pressurized via one or more throttle openings. In spite of the advantageous dampening of the rpm regulating device provided by this arrangement, it is necessary for smooth operation of the internal combustion engine to choose the proportional band of the rpm regulating device in such a manner that the idling rpm can fluctuate over an undesirably wide range in actual practice. If, for reasons of fuel economy, the idling rpm is set at a low level, it is possible for the idling rpm to drop too low due to this 'softness' of the rpm regulating device resulting in an engine which operates unevenly, noisely or even stops running, the latter caused by the further presence of inertial stress of cold lubricaing oil in the engine, of the actuation of an air conditioner, and/or of an automatic vehicle power assist, or a similar phenomena.

OBJECT AND SUMMARY OF THE INVENTION

The principal object of the rpm regulating device of the present invention is to advantageously provide that a greater injection quantity than that provided by the basic injection adjustment and/or the size and quantity of the centrifugal weights of the centrifugal governor, and the arrangement at the regulator springs are provided to the internal combustion engine as soon as the rpms threaten to reach an undesirably high deviation from the set value.

It is a further object of the invention to provide that the idling speed is kept constant.

It is another object of the invention to maintain the operating rpm during varying power output with only slight deviation from that desired and to quickly adjust for larger deviation. If the internal combustion engine also drives an alternating current generator these advantages are especially noticeable.

It is a still further object of the invention to control such power losses due to friction as additionally appear in a still cold engine.

The invention will be better understood and further objects thereof will become more apparent from the ensuing detailed description of two preferred embodiments taken in conjunction with the drawings.

DESCRIPTION OF THE PREFERRED EMBODIMENT

Figures 1, 2:
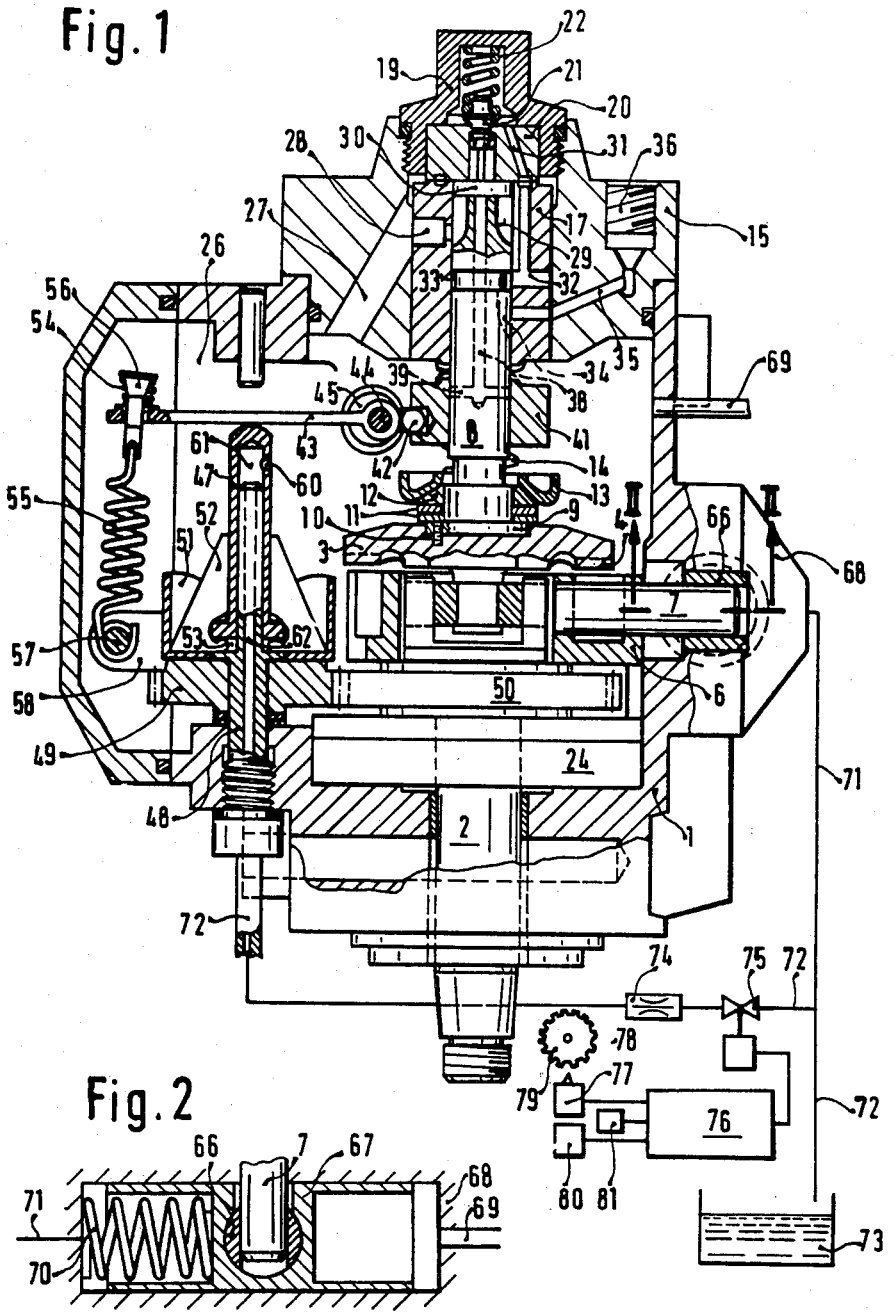
FIG. 1 shows the rpm regulating device of the invention in a longitudinal cross-section.
FIG. 2 shows a detail of the rpm regulating device in cross-section along a line II—II in FIG. 1.

Turning now to FIG. 1, in a housing 1 of a fuel injection pump serving a multicylinder internal combustion engine (not shown) there is supported a drive shaft 2 coupled with a cam disc 3 which carries as many camming protrusions 4 as there are cylinders in the engine. The track of the cam disc 3 is engaged by rollers, not shown, which are held in a ring 6. The latter is inserted into the pump housing 1 and is rotatable about the axis of the shaft 2 by means of a pin 7 extending into the ring 6. A fuel pumping and distributing member 8 has, at its side adjacent its drive means, a collar 9 which is coupled with the cam disc 3 by means of a pin 10.

On the collar 9 there are disposed in a face-to-face relationship two sliding discs 11 and an upwardly spherical disc 12 against which there is pressed a complemental counterface of a yoke 13 by means of two axially parallel coil return springs 14 (only one shown) disposed at 180° with respect to the axis of the pump. The return springs 14 engage a pump block 15 which is inserted in a fluid tight manner in an opening of the pump housing 1. Under the effect of the springs 14 the cam disc 3 is continuously pressed against the rollers supported by the ring 6.

The pumping and distributing member 8 is slidably situated in a cylinder sleeve 17 which is fixedly inserted into the pump block 15. The latter is closed at the top by a threaded cap 19 which presses a valve seat body 20 against the edge face of the cylinder sleeve 17. In an axial bore of the valve seat body 20 there is slidably arranged a movable valve member 21 which, in its closed position, is pressed against the valve seat body 20 by means of a spring 22 seated in a cavity of the closure cap 19.

To the pump shaft 2 there is affixed a rotary positive displacement pump 24 which serves as a fuel supply pump and which delivers fuel directly into the inner chamber 26 formed in the housing 1. From the inner chamber 26 there extends a channel 27 which leads to an inlet channel 28 in the cylinder sleeve 17. The inlet channel 28 cooperates with longitudinal grooves 29 provided in the lateral face of a terminal portion of the pumping and distributing member 8. The longitudinal grooves 29 communicate with a pump work chamber 30 controlled by the pressure valve 20, 21. From the cavity of the threaded cap 19 which is disposed downstream of the valve 20, 21, there extends a channel 31 which passes through the valve seat body 30 and the wall of the cylinder sleeve 17 and which opens into a radial channel 32 provided in the cylinder sleeve 17. The channel 32 cooperates with an annular groove 33 of the pumping and distributing member 8. From the annular chamber 33 there extends, in the pumping and distributing member 8, an axially oriented distributor groove 34 which cooperates with the outlet channels 35 (only one shown). The latter are disposed radially with respect to the cylinder sleeve 7 and in an inclined manner in the pump block 15. They open into threaded coupling outlets 36 to which there are connected injection conduits (not shown) leading to the fuel injection nozzles (also not shown) of the internal combustion engine. Similarly to the camming protrusions 4 of the cam disc 3, the longitudinal grooves 29 and the outlet channels 35 with the coupling outlets 36 are equal in number to that of the cylinders of the internal combustion engine.

In the pumping and distributing member 8 there is provided an axial channel 38 which extends from the pump work chamber 30 to a transversal channel 39. The mouths of the transversal channel 39 in the lateral face of the pumping and distributing member 8 cooperate with a quantity adjustment member embodied as a control sleeve 41 which is axially displaceable on the pumping and distributing member 8. For causing an axial displacement of the control sleeve 41, into a depression of the latter there extends a spherical terminus of an arm 42 of a two-arm lever 42, 43 which is pivotally held on a pin 44. The pin 44 is disposed in an eccentric manner on the radial face of a shaft 45 which is supported in the pump housing 1 and which serves for the setting of the full load fuel quantities and for a fuel shutoff.

The other arm 43 of the two-arm lever 42, 43 is engaged by the spherical terminus of a governor member 47 of an rpm regulator which is slidable on a regulator shaft 48 fixedly attached to the housing 1. On the regulator shaft 48 there is rotatably mounted a spur gear 49 which meshes with a spur gear 50 keyed to the pump drive shaft 2. With the spur gear 49 there are fixedly connected sheet metal pockets 51 in which there are supported centrifugal weights 52. Each of the latter engages the governor member 47 by means of an arm 53.

The arm 43 of the two-arm lever 42, 43 is exposed to the force of a compression spring 54 and a tension spring 55 which serve as regulator springs. The compression spring 54 engages directly the lever arm 43 and is supported by a flariing pin 56. Into the pin 56 there is hooked one end of the tension spring 55, the other end of which is in engagement with a pin 57. The latter is affixed to a setting lever 58 which, for the purpose of adjusting the rpm to be regulated, is operable from the outside of the housing 1. The governor member 47 has a radial throttle opening 60 extending into a hollow interior which defines an inner work chamber 61. The work chamber 61 is further defined by a regulator shaft 48 which extends into the governor member 47. The length of the work chamber 61, and thus its volume, is variable by displacement of the governor member 47 on the regulator shaft 48. The regulator shaft 48 includes a longitudinal bore 64 which communicates with a conduit 72 which leads to a tank 73 from which the fuel supply pump 24 is supplied. A throttle 74 and a magnetic valve 75 are incorporated in the conduit 72. The magnetic valve 75 is connected to an electronic control device 76 which communicates with a sensor comprising a rpm transmitter 77. The sensor reads a transmitter wheel 79 provided with cogs 78 which is driven by the engine. In addition to the rpm transmitter 77, or instead of it, a torque pickup 80 assigned to the engine can communicate with the control device 76. In addition a temperature sensor 81, which is adapted to measure the temperature of the internal combustion engine or of its lubrication oil, can communicate with the control device 76.

As best seen in FIG. 2, the pin extends with its terminus projecting from the housing 1, into a cylindrical joint 66 which is rotably arranged in a piston 67 of a hydraulic setting mechanism, the housing 68 of which adjoins the housing 1 of the fuel injection pump (FIG. 1). The piston 67 is exposed to the pressure prevailing in the inner chamber 26 of the housing 1 through a channel 69. The other terminal face of the piston 67 is engaged by a spring 70. This terminal face of the piston 67 communicates with the induction side of the fuel supply pump 24 via a channel 71.

OPERATION OF THE PREFERRED EMBODIMENT

When the internal combustion engine is running, the drive shaft 2 of the fuel injection pump rotates, causing rotation of the cam disc 3 which in cooperation with the rollers of the ring 6 effects an axial reciprocating motion and a simultaneous rotary motion of the pumping and distributing member 8. During this operation the cam disc 3 is maintained in continuous contact with the afore-noted rollers by means of the return springs 14. The pumping and distributing member 8 is shown in FIG. 1 in its lower dead center position. The pump work chamber 30 is charged with fuel through the inlet channel 28. As the cam disc 3 rotates first the inlet channel 28 is closed by the land of the pumping and distributing member 8. During the immediately following effective pressure stroke of the pumping and distributing member 8, fuel is delivered from the pump work chamber 30 through the open valve 20, 21, the channels 31 and 32 into the annular groove 33 and therefrom through the distributor groove 34 to one of the outlet channels 35 and then to the associated outlet coupling 36. Therefrom the fuel is admitted to the individual fuel injection nozzles of the internal combustion engine.

The fuel supply pump 24 supplies fuel into the inner chamber 26 of the fuel injection pump at an rpm-dependent pressure. The pressurized fuel exerts a force on the piston 67 of the hydraulic setting mechanism and thereby angularly adjusts in an rpm-dependent manner the ring 6 through the pin 7. The angular position of the ring 6 determines the beginning of the fuel flow to the injection pump.

As the rpm increases, the centrifugal weights 52 of the centrifugal regulator swing outwardly and displace the governor member 47 upwardly against the force of the regulator springs 54, 55. During this occurrence, first the spring 54 which serves for the regulation of the idling rpm, is compressed and thereafter the spring 55 serving for the regulation of the operational rpm is tensioned. During this displacement of the governor member 47, on the one hand, the control sleeve 41 is shifted downwardly so that the fuel quantities delivered by the fuel injection pump are decreased (partial load).

If the internal combustion engine is subjected to a load during idling in such a manner that its idling rpm threatens to drop below a desired level, in spite of the centrifugal weights 52 pressing against the regulator springs 54, 55, then the control device 76 intervenes, dependent upon the rpm signaled from the rpm transmitter 77, and opens the magnetic valve 75. The opened magnetic valve 75 lets fuel exit from the inner chamber 26 through the throttle opening 60, into the work chamber 61, to the longitudinal bore 62, and then to conduit 72 and on to the tank 73 or the fuel supply pump 24. As a result of the fuel outflow, the pressure in the work chamber 61 drops to a level lower than that in the inner chamber 26 due to the throttle opening 60. Therefore, the governor member 47 is hydraulically actuated in the direction of the arm 53 of the centrifugal weights 52. The effect of this position change is the same as if the regulator springs 54, 55 were being additionally tensioned by the settig lever 58. The hydraulically-imposed shift of the governor member 47, therefore, causes an upward displacement of the control sleeve 41 with a known consequence, that is, a larger fuel quantity is injected into the internal combustion engine. This added quantity of fuel works counter to the effect of the loads, which were mentioned above in the introduction, lowering the divergence of the rpm level from its desired value. The cross-sections of the throttle opening 60 and the throttle 74 are chosen such that the desired enhancement or dampening of the fuel quantity to be injected takes place.

Naturally, instead of a fixed-adjustment throttle 74 and a magnetic valve 75 opening to its full cross-section, a variable-section throttle can be used to achieve a continuous enhancement of the fuel quantity. Known proportional valves can be used for such a throttle.If necessary, it is also possible to open the magnetic valve 75 in quick sequence for a short period.

In the example described above the load on the internal combustion engine is measured indirectly by a drop in the rpm. Alternatively, measuring the charge is also possible with the torque pickup 80. This allows for an adjustment with much less deviation at higher rpm levels as well. The torque pickup can comprise in a known manner a torque measuring shaft, or a reaction moment transmitter, or a current intensity measuring device connected to a generator.

In addition to measuring the rpm and/or the torque, the temperature of the lubricaion oil in the internal combustion engine can be measured through the use of a temperature sensor 81 and this value be taken into account by the control device 76 in determining the quantity of fuel to be injected. In a similar manner the temperature of the combustion air could be measured and taken into account by the control device.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. In a fuel injection apparatus for internal combustion engines, including: a fuel supply pump; a housing defining an inner chamber into which fuel is delivered by the fuel supply pump; a fuel injection pump delivering fuel from the inner chamber to the engine; an rpm regulator having an adjustable governor member; adjustable lever means associated with said governor member for initial setting thereof; a work chamber disposed in said governor member communicating via a throttle with said inner chamber; bore means provided within said governor member in communication with said work chamber; and an hydraulic setting mechanism which varies the moment of fuel delivery by the fuel injection pump as a function of pressure in the inner chamber, the improvement comprising:

a control line connects said bore means with a fuel supply tank; said control line is further provided with a magnetic valve to control fuel flow; said magnetic valve is further connected to an electronic control device; and said electronic control device includes at least one sensor for measuring at least one operational characteristic of the internal combustion engine.

2. A rpm regulating device according to claim 1, characterized in that said sensor comprises a rpm transmitter for measuring the rpm of the internal combustion engine.

3. A rpm regulating device according to claim 1, characterized in that said sensor comprises a torque pickup for measuring the load factor exerted upon the internal combustion engine.

4. A rpm regulating device according to claim 1, characterized in that said sensor comprises a temperature sensor for measuring the temperature of the internal combustion engine.

5. A rpm regulating device according to claim 1, characterized in that said control line further includes a throttle means upstream of said magnetic valve.

6. A rpm regulating device according to claim 1, characterized in that said magnetic valve includes an adjustable cross-section and said adjustable cross-section is controlled by said electronic control device.

7. A rpm regulating device according to claim 1, characterized in that said electronic control device emits impulses of variable sequence and duration to open the magnetic valve.

* * * * *